United States Patent [19]

Ishikawa et al.

[11] Patent Number: 4,805,695

[45] Date of Patent: Feb. 21, 1989

[54] COUNTERFLOW HEAT EXCHANGER WITH FLOATING PLATE

[75] Inventors: Yoshitaka Ishikawa; Takeo Matsumoto, both of Tokyo, Japan

[73] Assignee: Sumitomo Heavy Industries, Ltd., Tokyo, Japan

[21] Appl. No.: 150,658

[22] PCT Filed: Apr. 22, 1987

[86] PCT No.: PCT/JP87/00256

§ 371 Date: Dec. 23, 1987

§ 102(e) Date: Dec. 23, 1987

[87] PCT Pub. No.: WO87/06686

PCT Pub. Date: Nov. 5, 1987

[30] Foreign Application Priority Data

Apr. 25, 1986 [JP] Japan ..... 61-96285

[51] Int. Cl.[4] ..... F28F 3/00

[52] U.S. Cl. ..... 165/166; 165/82

[58] Field of Search ..... 165/82, 166

[56] References Cited

U.S. PATENT DOCUMENTS

| | | | |
|---|---|---|---|
| 1,833,166 | 11/1931 | Lucke | 165/166 |
| 2,064,928 | 12/1936 | Lewis | 165/166 |
| 3,363,681 | 1/1968 | Revilock et al. | 165/166 |
| 3,847,211 | 11/1974 | Fischel et al. | 165/166 |
| 4,475,589 | 10/1984 | Mizuno | 165/166 |

FOREIGN PATENT DOCUMENTS

| | | |
|---|---|---|
| 57-23790 | 2/1982 | Japan . |
| 57-122289 | 7/1982 | Japan . |
| 58-158972 | 10/1983 | Japan . |
| 60-89691 | 5/1985 | Japan . |
| 61-204187 | 12/1986 | Japan . |
| 61-204189 | 12/1986 | Japan . |
| 61-204185 | 12/1986 | Japan . |
| 61-204186 | 12/1986 | Japan . |
| 61-204188 | 12/1986 | Japan . |
| 737717 | 6/1980 | U.S.S.R. . |
| 83/03663 | 10/1983 | World Int. Prop. O. . |

*Primary Examiner*—Samuel Scott
*Assistant Examiner*—Noah Kamen
*Attorney, Agent, or Firm*—Kerkam, Stowell, Kondracki & Clarke

[57] ABSTRACT

Counterflow heat exchanger with a floating plate, which comprises a casing made of a pair of rectangular parallel-spaced wall members and four pieces of bar members connecting the corresponding corners of the pair of wall members, a pair of seal strips located inside said bar members through elastic members diagonally with regard to a line connecting the centers of the wall members, being extended so as to cover and seal a pair of the sides formed by a longer side of the wall members and the bar members, leaving a part of the sides uncovered. More than two sheets of floating plates are spaced apart from each other contained in a space formed by the seal strips and wall members. A spacer in a channel is formed between the floating plates, and a structure for controlling the flow of fluids within the channels is included. By making fluids having different temperatures flow countercurrently to each other through the channels, efficiency of heat exchange of the heat exchanger can be improved. The construction affords easy assembly and also a compact form.

15 Claims, 10 Drawing Sheets

COUNTERFLOW HEAT EXCHANGER WITH FLOATING PLATE

FIELD OF THE INVENTION

The present invention relates to a plate type heat exchanger and more specifically to a floating plate type heat exchanger which comprises a plurality of exchanger plates elastically supported by supporting members and in which respective fluid streams for heat exchange flow in directions perpendicular to each other at least just before inflow to the heat exchanger and just after outflow from the heat exchanger.

More precisely, the heat exchanger according to the present invention is primarily intended for applications in the field of heat recovery, for example, by exchanging heat between a hot stream leaving a processing section and a cold stream entering the processing section.

PRIOR ART

As for heat exchangers advantageously used in such field, a floating plate type heat exchanger is disclosed in Japanese Patent Application Laid-Open No. Sho 59-500580-A, in which the exchange plates are elastically supported by supporting members. The structure of the floating plate type heat exchanger disclosed in this patent application is schematically shown in FIG. 6.

Thus, FIG. 6 is a partially broken-away perspective view of the whole unit of the floating plate type heat exchanger. The floating plate type heat exchanger depicted in the drawing comprises a supporting structure composed of a pair of rectangular end walls 10 and corner posts 12 which located between the end walls 10 and joined at their opposite ends to respective corners of the end walls to form an enclosing frame.

A plurality of rectangular plates 14 which constitute a heat exchange medium are mounted between the rectangular end walls 10 in parallel with the latter and with a spacing to each other. On one surface of each rectangular plate 14, a plurality of dimples 16 are provided so as to ensure a spacing and to form a channel between each pair of adjacent rectangular plates. The dimples 16 have an approximatively elongated circular shape and are formed to define parallel projections from one surface of each rectangular plate.

FIGS. 7 (*a*) and 7 (*b*) depict a heat exchange plate constituting a part of the above-mentioned heat exchanger.

As shown in FIGS. 7 (*a*) and 7 (*b*), dimples 16 in adjacent rectangular plates are formed at right angles to each other. In addition, each rectangular plate is folded at both edges which are parallel with a longitudinal direction of the dimples so as to form side walls of the channel just below each rectangular plate. The dimples then serve also as supports against the force normal to the surface of the rectangular plates.

Each dimple is shaped in an elongated circle along the direction of fluid stream within the channel into which the dimples project, so as not to give significant resistance to the fluid stream. Accordingly, it is advantageous that the fluid flows in the direction of the arrow X in FIG. 7 (*a*), whereas the fluid flows in the direction of the arrow Y in FIG. 7 (*b*). FIG. 7 (*c*) is a cross-sectional view taken along a plane perpendicular to the plate plane of such a heat exchanger.

Furthermore, resilient separators not shown in FIG. 6 are inserted between the rectangular plates 14. Therefore, the rectangular plates 14 are elastically supported in the direction normal to their surfaces so that they are positioned with an appropriate spacing. By supporting the plates elastically in this way, thermal expansion in the direction normal to the plane of the rectangular plate is absorbed, thereby avoiding thermal deformation of the external surface of the heat exchanger.

In addition, as shown in FIG. 6, seal strips 18 which have an L-shaped cross-section are attatched to each corner of each rectangular plate 14, and a roll spring 20 formed of a resilient thin metal plate spirally rolled at least one turn, is inserted between the outside surface of the seal strip and the inside surface of the corner post 12. Stoppers 22 which are provided at the outside surface of the roll spring 20 prevent the roll spring 20 from getting out of the place.

In this way, the roll springs 20 not only seal the spacing between the outside surface of the seal strips 18 and the inside surface of the corner posts 12 but also absorb the thermal expansion along a direction parallel to the surface of the rectangular plates 14.

In the floating plate type heat exchanger of the above-mentioned structure, in which the channels are formed between each pair of rectangular plates 14 so that adjacent channels are perpendicular to each other, heat exchange is realized through the rectangular plates between two fluids, one fluid being a hot fluid stream which passes through all the channels in the same direction, while the other fluid being a cold fluid stream which passes through all the channels normal to the former.

The above-mentioned floating plate type heat exchanger, which is disclosed in Japanese Patent Application Laid-Open No. Sho 59-500580-A, is characterized in that it hardly undergoes thermal deformations or break-downs caused by these thermal deformations, and that it is easily assembled.

In order to utilize such a floating plate type heat exchanger more advantageously, the applicant has already proposed several improvements in structure. However, these improvements were not a basic modification of the heat exchanger shown in FIG. 6.

In other words, in the floating plate type heat exchanger of the prior art as described above, the fluids for heat exchange will flow in a direction perpendicular to each other on both surfaces of the rectangular plate (this type of fluid flow will be called a "crossflow type" hereinafter). However, compared with a counterflow type heat exchanger in which two fluids with different temperatures flow in the direction opposite to each other on each surface of the heat exchanger plate, the achievable temperature efficiency is, in principle, quite low in a crossflow type heat exchanger. Accordingly, in many cases, desired heat exchange capacities are not obtained simply by enlarging the heat transfer surface.

It is general in practical use to connect a plurality of crossflow type heat exchanger units via ducts so as to form a multistage heat exchanger. FIGS. 9 (*a*) and 9 (*b*) are diagrams of multistage heat exchangers. Necessary heat exchange capacity is obtained by connecting two heat exchanger units 40 via a duct 41 as in FIG. 9 (*a*) or by connecting three heat exchanger units via two ducts 41 as in FIG. 9 (*b*), etc.

However, it is apparent that the multistage heat exchanger with such a construction presents disadvantages in use because of its larger size or heavier weight than the heat exchangers themselves. In addition, when fluids pass through such multistage heat exchangers, the efficiency as heat exchanger becomes lower because of large loss of dynamic pressure of the fluid caused by the contraction and diffusion of the fluid in entering into and leaving from the heat transfer elements of each stage. Furthermore, when the fluids for heat exchange are a gas, the loss of pressure by frictions cannot be neglected in passing through the duct.

In order to explain this in more detail, we refer to "Heat transfer technology reference book", The Japan Society of Mechanical Engineers, pp. 184–190. According to this book, the relation between the quantity of heat exchange Q and the average temperature difference $\Delta t_m$ in a heat exchanger is expressed as:

$$Q = KF\Delta t_m \quad (1)$$

where F is the heat transfer surface ($m^2$);

Q is the quantity of exchanged heat per hour (kcal/h); and

K is a coefficient.

Accordingly, if the coefficient K is known in the expression (1), the relation between Q and the heat transfer surface F can be determined.

FIG. 3 is a graph representing the temperature variation in a counterflow type heat exchanger along the direction of the fluid stream. This graph is taken from a similar document. According to this graph, the temperature difference $\Delta t_m$ between a high temperature fluid W and a low temperature fluid W' is given as a function of the temperatures of the respective fluids at the ends of the heat exchanger $t_1$, $t_1'$, $t_2$, $t_2'$ as:

$$\Delta t_m = \frac{\Delta_1 - \Delta_2}{2.303 \log(\Delta_1/\Delta_2)} \quad (2)$$

where $\Delta_1$ and $\Delta_2$ are respectively the temperature difference between the two fluids at the entrance and at the exit of the heat exchanger, as shown in FIG. 3.

When a plurality of crossflow heat exchangers are connected to form a multistage heat exchanger, the temperature difference $\Delta t_m$ can be obtained from the following expression:

$$\Delta t_m = \psi \frac{(t_1 - t_2') - (t_2 - t_1')}{2.303 \log(t_1 - t_2')/(t_2 - t_1')} \quad (3)$$

Therefore, the temperature difference $\Delta t_m$ in a crossflow heat exchanger can be obtained by multiplying the temperature difference $\Delta t_m$ in the counterflow heat exchanger by the correction coefficient $\Psi$. This correction coefficient $\Psi$ can be known from the graph shown in FIG. 4 which represents the correction coefficient for a crossflow type heat exchanger in which two fluids for heat exchange do not mix.

This type of floating plate heat exchanger is often used as an air preheater for boilers or furnaces, in which the actual heat flow ratio R is about 0.8. If one wishes the temperature efficiency to be of the order of 0.8 at the low temperature side, the value of the correction coefficient is obtained from FIG. 4 as 0.65. In other words, the heat transfer surface of a counterflow type heat exchanger, which is designed for obtaining the same quantity of heat exchange as a crosscounter flow type heat exchanger, is 65% of that of a crossflow type heat exchanger.

On the other hand, in order to obtain a desired quantity of heat exchange by using a multistage heat exchanger including a cascade of complete crossflow type heat exchangers, it is necesary to increase the value of the correction coefficient by reducing $\eta$ in FIG. 4. For example, in case of a 2-stage heat exchanger, in order to maintain the temperature efficiency at 0.8, it is sufficient to take 0.4 for $\eta$ for each stage. The corresponding correction coefficient $\Psi$ is obtained as $\Psi = 0.96$. As a result, the heat transfer surface is reduced to 0.65/0.96 of that of a single crossflow type heat exchanger.

However, the heat transfer surface of a crossflow type multistage heat exchanger is still larger than that of a counterflow type heat exchanger by $1/0.96 = 1.04$. A variety of problems caused by the multistage structure have already been mentioned.

As explained above, a floating plate type heat exchanger presents disadvantages compared with a counterflow type heat exchanger even after many improvements mentioned above.

An object of the present invention is therefore to provide a counterflow type heat exchanger which is advantageous in heat exchange efficiency, while maintaining the advantages of the floating plate type heat exchangers of the prior art that they undergo few thermal deformations or few thermal breakdown and that they can be easily assembled.

SUMMARY OF THE INVENTION

Thus, there is provided in accordance with the present invention a counterflow type floating plate heat exchanger comprising an enclosing frame composed of a pair of parallel rectangular wall members and four corner members connecting the pair of wall members at least at the corresponding corners;

four pieces of seal strips in contact with an inside surface of the corner members through resilient members for sealing at least the inside surface of each corner member, a pair of seal strips at the diagonal positions with respect to the line connecting between the respective centers of the wall members being extended along a pair of planes defined by the longer sides of the wall members and the corner members so that the planes are sealed leaving unsealed portions thereof;

at least three separate parallel floating plates mounted, in parallel to the wall members and in contact with the seal strips, within a space defined by the seal strips and the wall members;

spacer means for maintaining a spacing between the floating plates for the channels defined between the floating plates; and control means for controlling the flow of fluids in the channels;

in which fluids which are different in temperature respectively flow in adjacent channels on opposite surfaces of each floating plate and heat exchange is realized between the fluids through each floating plate, characterized in that the fluids which are different in temperature flow in directions opposite to each other and along a portion of at least two-thirds of the longer side of the channels.

The ratio between the longer side and the shorter side of the floating plate of the counterflow type heat exchanger is preferably 7:2.5, the ratio being determined based on the experiments by the inventers.

Advantageously, each of the floating plate comprises a plurality of elongated circular shaped dimples projecting from one surface and/or the other surface of the floating plate, so that the dimples define a spacing between the adjacent floating plates, and, when the dimples are arranged effectively, the dimples constitute means for controlling the flow of the fluids.

Furthermore, the means for controlling the flow of fluids may consist of plates mounted at the entrance and/or the exit of the fluids or of the combination of the plates and the dimples.

In the floating type plate heat exchanger according to the present invention, channels are formed by stacking the floating plates, their horizontal cross-section being rectangular. These channels are divided into two groups: one group of channels are such that a fluid flows into the channel from one shorter side of the rectangle and flows out from the opposite shorter side; and the other group of channels are such that a fluid flows into the channel from a part of one longer side of the rectangle at a downstream side of the one group of channels and flows out from a part of the opposite longer side at an upstream side of the one group of channels. Therefore, the fluid flowing in and out from the longer sides of the rectangle moves in the direction opposite to that of the fluid flowing in and out from the shorter sides in a certain portion between the entrance and the exit, thereby resulting in a counterflow type heat exchange. Experiments have revealed that the ratio between the longer side and the shorter side of the rectangle heat transfer surface of the floating plate is at least 2.5:7.

The structure of the counterflow type floating plate heat exchanger according to the present invention is the same as that of a crossflow type floating plate heat exchanger disclosed in Japanese Patent Application Laid-Open No. Sho 59-500580-A. Therefore, the advantages of the floating type heat exchangers that there are few thermal deformations or few breakdowns caused by thermal deformation are maintained. In addition, a variety of propositions for the improvements already made on such floating plate type heat exchangers can be applied to the present invention.

In order to use such floating plate type heat exchangers more advantageously, the following improvements in structure have been already proposed by the applicant: a structure in which the members for maintaining the spacing between the rectangular plates are fixed more firmly (Japanese Utility Model Application Laid-Open No. Sho 61-204186-A); a structure in which the thickness of each channel is increased by enlarging the spacing between each pair of adjacent rectangular plates through dimples 26 formed on both surfaces of each rectangular plate 24 to contact the bottom of the dimples of adjacent rectangular plates, as shown in FIG. 8 by a cross-sectional view of a channel defined by rectangular plates 24 (Japanese Utility Model Application Laid-Open No. Sho 61-204187-A); a structure for avoiding the heat influence to a supporting structure and for increasing the heat recovery efficiency by putting heat insulators between the heat exchange portion formed by a rectangular plate and the supporting structure for the heat exchange portion (Japanese Utility Model Application Laid-Open No. Sho 61-204188-A); a structure in which the assembly of the rectangular plates is supported by a combination of rib members and the dimples formed on the surface of the rectangular plates (Japanese Utility Model Application Laid-Open No. Sho 61-204189-A); a structure for improving the flexural rigidity of the rectangular plates by providing at the edge of each rectangular plate a mechanism for preventing the bending of the plates (Japanese Utility Model Application Laid-Open No. Sho 61-204185-A). These improvements can all be applied to the counterflow type floating plate heat exchangers of the present invention.

In addition, in the heat exchanger of the present invention, by making the heat exchange portion rectangular and by restricting with a use of seal strips the width of the entrance and the exit for the fluid which flows in and out through the longer side of the rectangular, the directions of the respective fluids at the center of the rectangular heat exchange portion are opposed to each other.

The fluid just after outflow from the heat exchanger and just before entering the heat exchanger turns its direction of flow by 90 degrees toward or from the center portion of the rectangular in which counterflow is realized. However, the fluid does not flow toward the areas "a" and "b" surrounded by dotted lines in FIG. 5. Therefore, it is advantageous to provide, within the channel, a means for diffusing and aligning the fluid according to the present invention.

The means for diffusing the fluid can be formed easily and effectively in the channel by adjusting the arrangement and the direction of the dimples which are formed on the surface of the heat exchanger plate to project into the channel.

Each dimple which is formed on the surface of the floating plate to project into the channel is an approximately elongated circle in shape, and therefore is least resistive to the fluid when the direction of the flow of the fluid and that of the longest dimension of the dimples are the same. By determining the arrangement and the direction of the dimples according to the preferable flow patterns of the fluid in the channel, the dimples can be used also as means for diffusion and alignment of the fluid. The floating plate comprising such dimples can be easily fabricated, for example, by pressing out a conventional steel plate.

The present invention also proposes more precise control means for aligning the flow of the fluid. Because the flow of the fluid is localized in a certain area even with the above-mentioned structure, it is advantageous to set plate-like means for aligning the flow in the corresponding channel at the place where the flow is localized so that the flow can be controlled more effectively.

Thus, according to the present invention, a floating plate type heat exchanger with high heat echange efficiency is realized.

THE BEST MODE OF CARRYING OUT THE INVENTION

In the following, the present invention is explained in detail and more concretely referring to non-limitative but preferred embodiments of the present invention.

Figure 1:
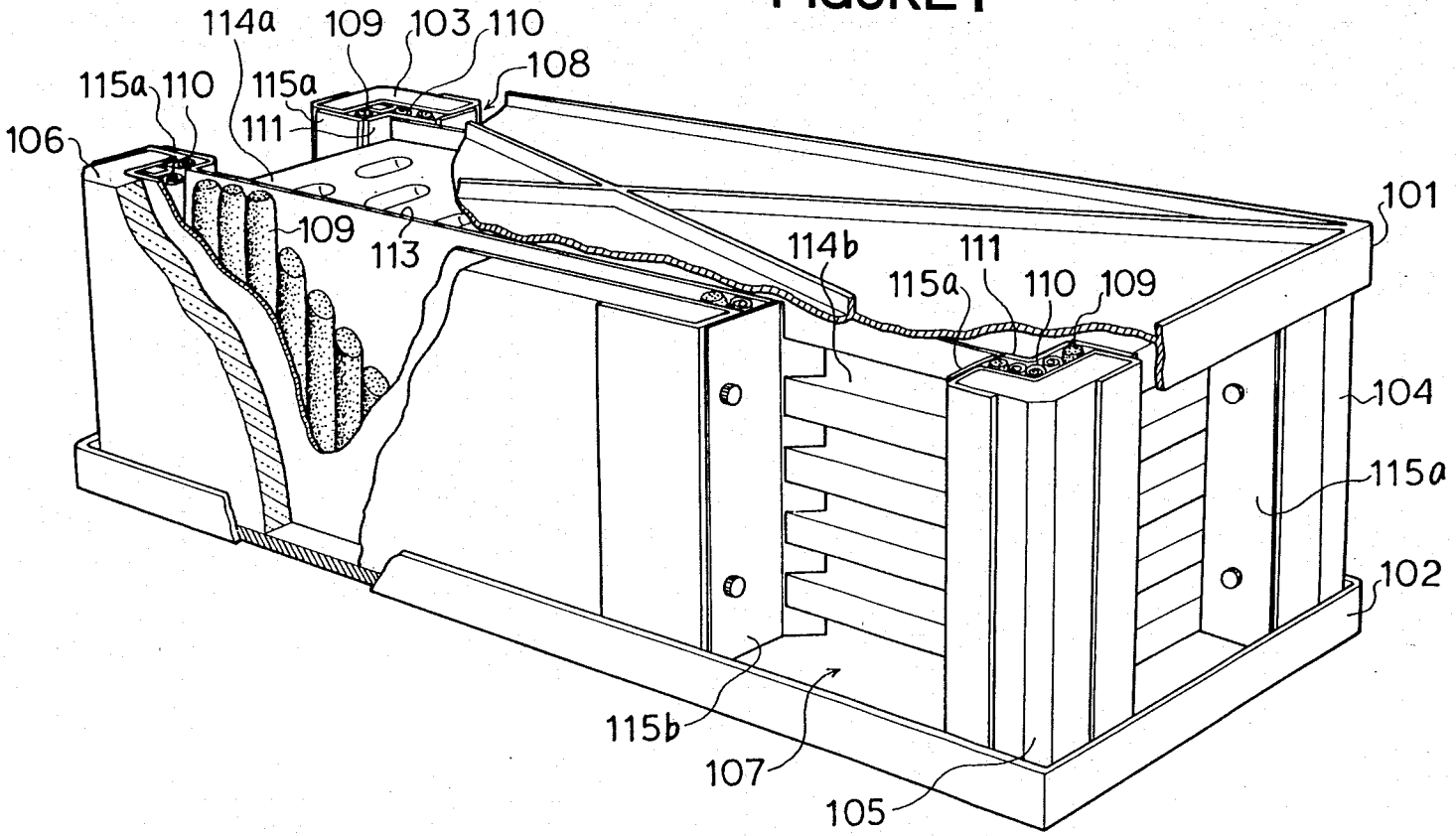
FIG. 1 is a partially broken-away perspective view showing a preferred embodiment of the counterflow type floating plate heat exchanger according to the present invention.

FIG. 1 is a partially broken-away perspective view of a preferred embodiment of a counterflow type floating plate heat exchanger according to the present invention. The heat exchanger comprises a heat exchange surface with a dimension 1200 mm×2635 mm.

As shown in FIG. 1, the structure of the heat exchanger according to the present invention is rather similar to that of a floating plate type heat exchanger of the prior art.

Wall members 101 and 102 are connected to each other at each corner through corner members 103, 104, 105, 106 to form an enclosing frame functioning as a support structure of the heat exchanger. In this embodiment, the corner members 104 and 106 are extending respectively along the longer side of the wall members 101 and 102 to an entrance 107 or to an exit 108 (which cannot be seen in FIG. 1 because it is hidden in the drawing) of a fluid.

Figure 2A:
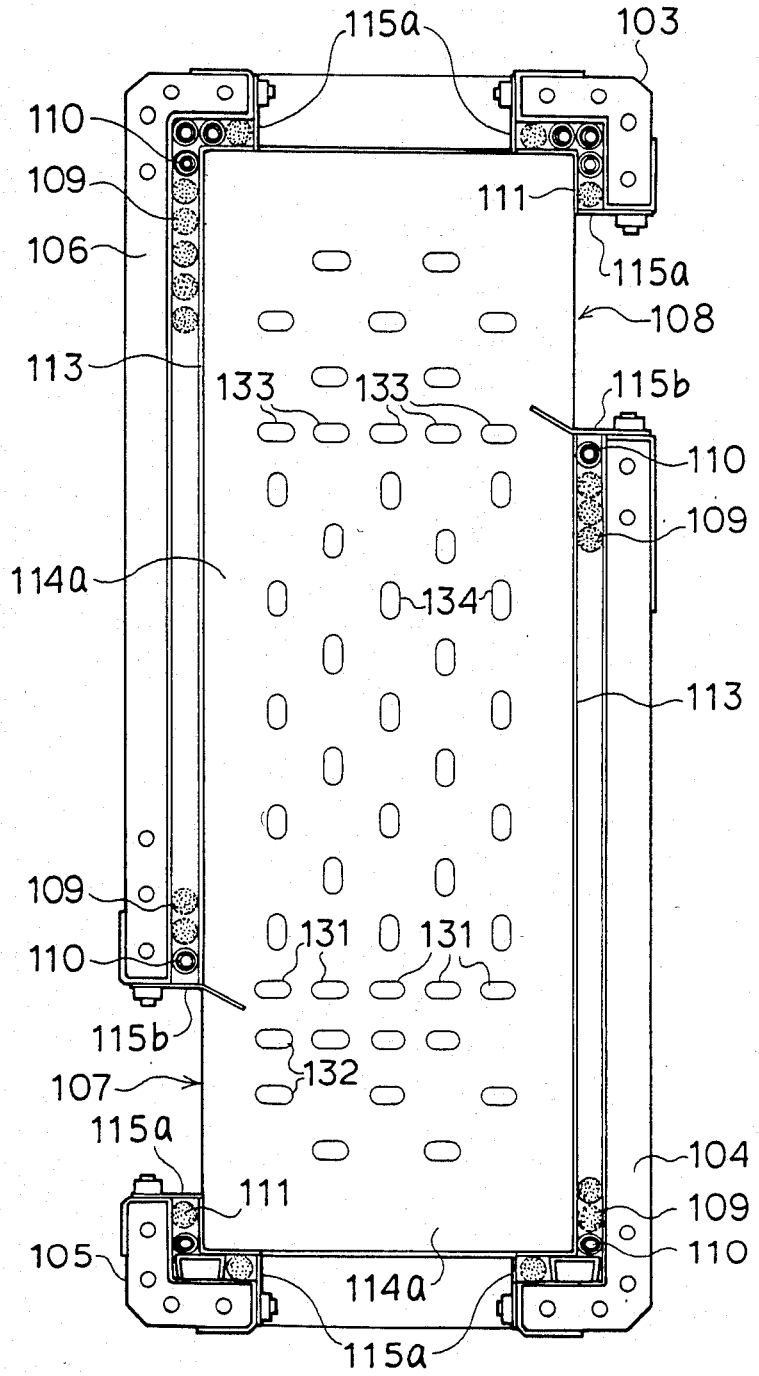
FIGS. 2 (*a*) and 2 (*b*) show examples of the arrangement and the direction of the dimples formed on each surface of the floating plate of the counterflow type floating plate heat exchanger in FIG. 1.
Figure 2B:
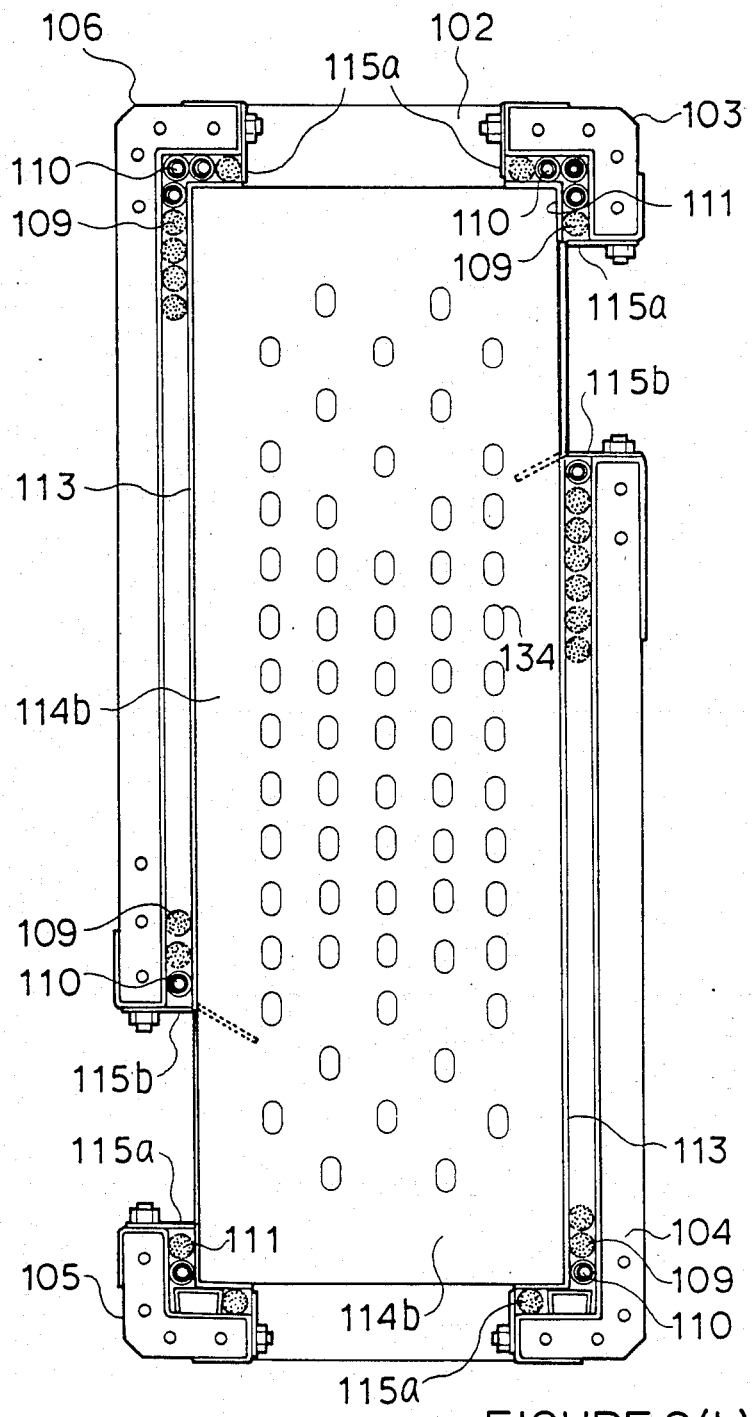
Figure 3:
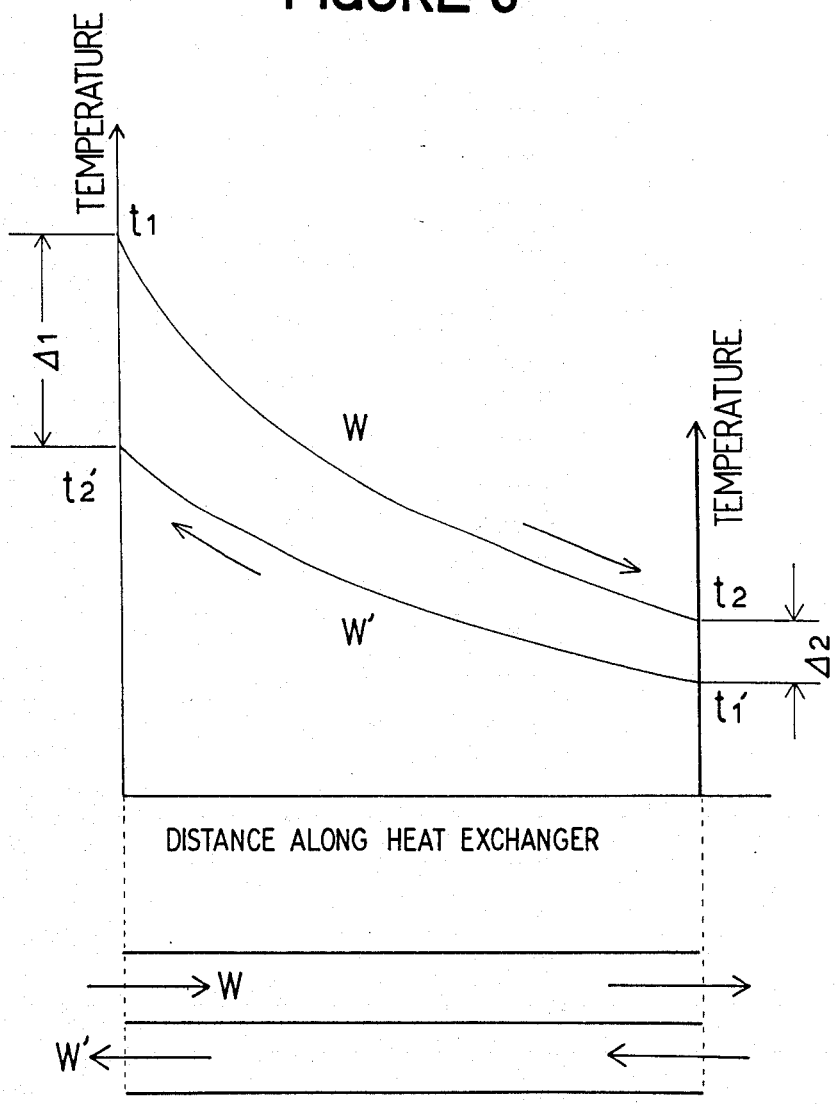
FIG. 3 is a graph showing the temperature variation of a fluid inside a counterflow type heat exchanger along the direction of the flow of the fluid.
Figure 4:
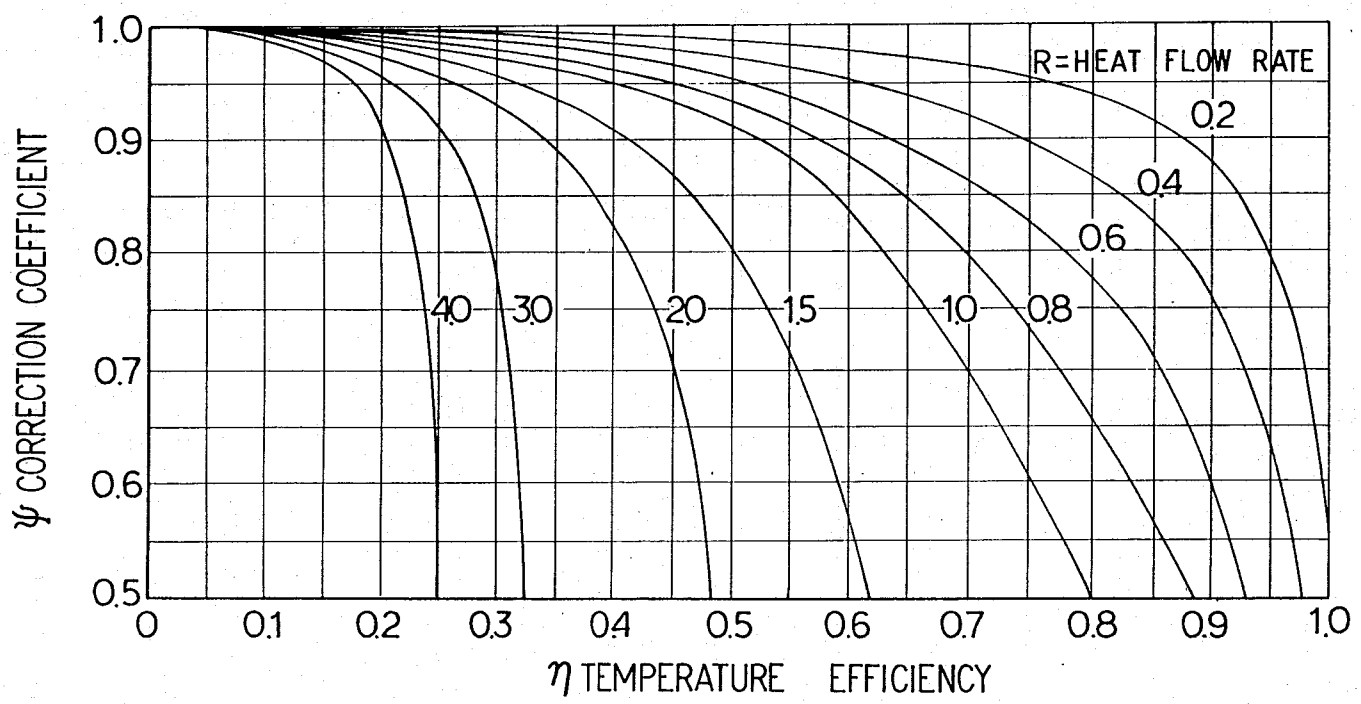
FIG. 4 is a graph for obtaining the correction coefficient in a crossflow type heat exchanger.

This structure is apparent in FIGS. 2 (*a*) and 2 (*b*) which are horizontal cross-sectional views of the heat exchanger of FIG. 1. In FIGS. 1, 2 (*a*) and 2 (*b*), the same reference numbers are given to the same elements.

As can be seen in FIGS. 2 (*a*) and 2 (*b*), each corner member 103, 104, 105, 106 pushs seal strips 111 and 113 toward the structure through heat insulation fillers 109 and a plurality of roll springs 110, so that the enclosed floating plates **114*a* and 114*b* are elastically supported from their lateral sides. Therefore, thermal expansion of the seal strips 111, 113 are absorbed by the roll springs 110. As a result, the seal strips 111, 113 do not bend nor get out of place by thermal effects, and the effect of the thermal expansion of the seal strips does not affect the supporting structure. At the lateral ends of each corner member 103, 104, 105, 106, stopper plates 115*a*, 115*b* are mounted so that the roll springs 110** do not get out of place.

On the other hand, among the four seal strips, a pair of seal strips 113 which are opposed to each other are each extending along the lateral sides of the floating plates and form respectively the entrance 107 and the exit 108 of the fluid in a pair of planes defined by the longer sides of the wall members 101, 102 and each corner member 103, 104, 105, 106. The entrance 107 and the exit 108 are situated at the diagonal positions in the pair of planes.

Resilient separators not shown are inserted in a compressed state (which is their normal state) between each pair of adjacent floating plates. As a result, not only the spacing between the adjacent floating plates are maintained but also the thermal expansion along the direction of the thickness of the floating plates is absorbed.

Figure 7:
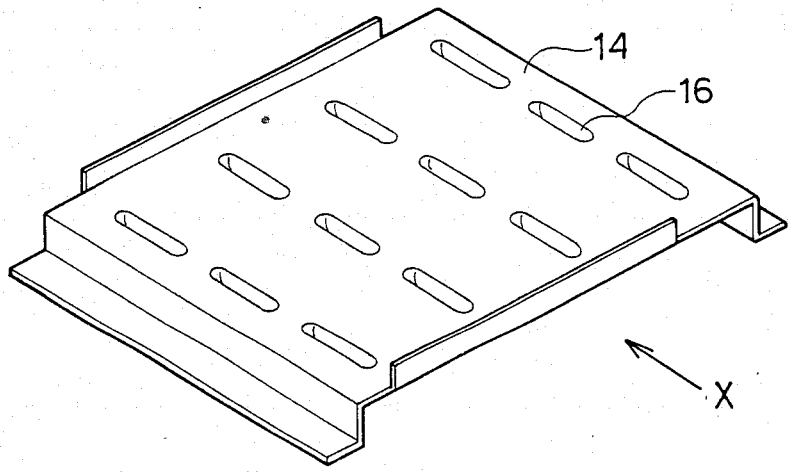
FIGURE 7 (a) PRIOR ART
FIGS. 7 (*a*), 7 (*b*) and 7 (*c*) show examples of the floating plates of the crossflow type heat exchanger of FIG. 6, FIGS. 7 (*a*) and 7 (*b*) showing the profile of different floating plates, and FIG. 7 (*c*) showing a cross-sectional view of a stack of the floating plates.
Figure 7:
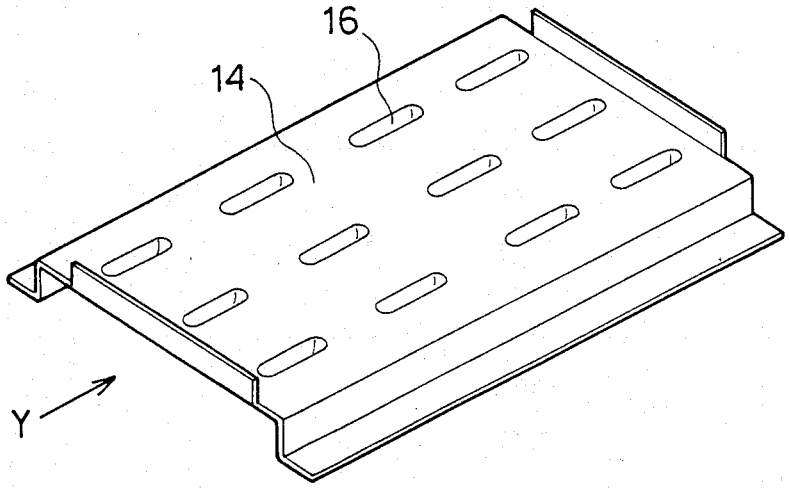
FIGURE 7 (b) PRIOR ART
Figure 7:
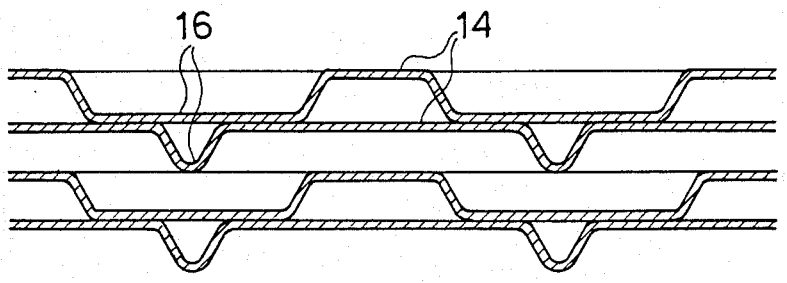
FIGURE 7 (C) PRIOR ART
Figure 8:
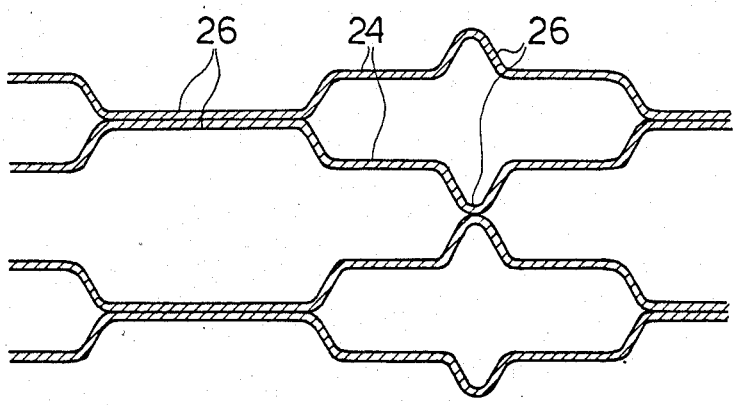
FIG. 8 is an explicative cross-sectional view of a floating plate of a floating plate type heat exchanger so far proposed.
Figure 9:
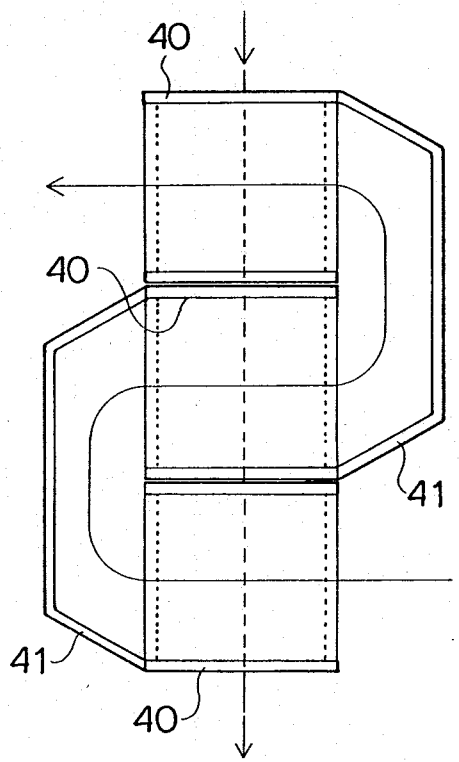
FIGURE 9 (b) PRIOR ART
FIGS. 9 (*a*) and 9 (*b*) are diagrams showing different connections for forming a crossflow type multistage floating plate heat exchanger.
Figure 9:
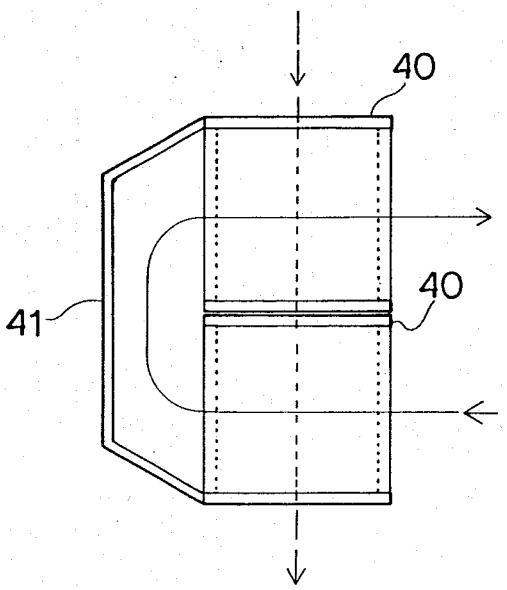
FIGURE 9 (a) PRIOR ART

Each of the floating plates **114*a* and 114*b***, just as the floating plates of the heat exchanger of the prior art shown in FIGS. 7 (*a*) and 7 (*b*), has a pair of vertical upwardly-folded edges along its longer sides or shorter sides, so that the upwardly-folded edges are in close contact with the floating plate just above (or just below) to form alternately orthogonalizing channels between the floating plates.

Suppose that the floating plates shown in FIG. 2 (*a*) is called an air plate and a lower temperature fluid which is flown into the heat exchanger from the longer side moves just above the air plate. Suppose also that the floating plates shown in FIG. 2 (*b*) is a full plate and a higher temperature fluid which flows into the heat exchanger from the shorter side moves just above the full plate.

Each of the floating plates **114*a* and 114*b*** further comprises a plurality of dimples projecting from both of its surfaces. FIG. 2 (*a*) shows the direction and the arrangement of the dimples in a channel where the fluid enters from one longer side of the floating plate and leaves from the opposite longer side; FIG. 2 (*b*) shows the direction and the arrangement of the dimples in a channel where the fluid enters from one shorter side of the floating plate and leaves from the opposite shorter side. As mentioned above, projecting dimples which are formed on both surfaces of the floating plate, but, for the clarity of the arrangement of the two kinds of dimples, only the dimples projecting upwardly from the plane of the drawings are shown in FIGS. 2 (*a*) and 2 (*b*).

Each dimple is approximately an elongated circle in shape. It is apparent that the dimples are least resistive to the fluid when their longest dimension is the same as that of the fluid. Accordingly, from the study of the direction and the arrangement of the dimples along the desired flow direction of the fluid in a channel, it was revealed that the arrangement and the direction shown in FIGS. 2 (*a*) and 2 (*b*) are one of preferred embodiments.

In FIG. 2 (*a*), the dimples 131, which extends perpendicularly against the air flow path to give a certain degree of pressure loss, serve as a distributor to make the air flow uniformly in the counterflow portion of the heat exchanger. The dimples 133 restrict the air flow at the exit side.

Figure 5:
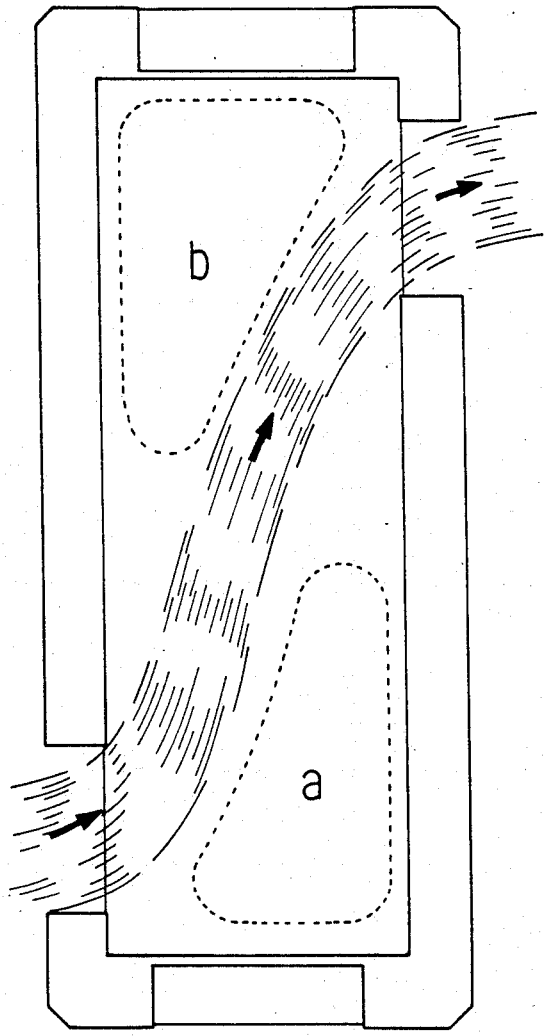
FIG. 5 is a schematic diagram showing the flow of a fluid in a rectangular channel.
Figure 6:
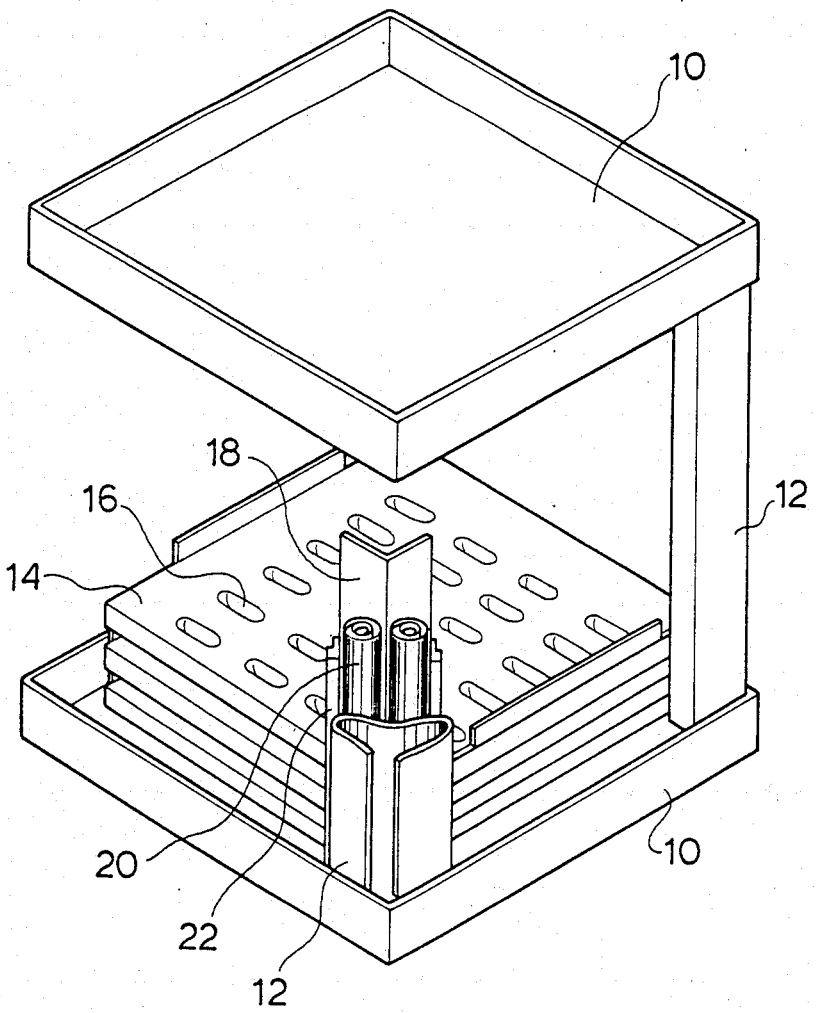
FIGURE 6 PRIOR ART
FIG. 6 is a partially broken-away perspective view showing the structure of a crossflow type heat exchanger of the prior art.

The dimples 134 serves as guide vanes for guiding the air introduced into the counterflow portion as a laminar flow toward the upward direction in the drawing. The dimples 132 are for guiding the air introduced from the entrance without losing its dynamic pressure toward the inside of the heat exchanger. Further, the dimples 132 change the direction of the air flow at the outlet by right angles without shortcutting the path as shown in FIG. 5.

The dimples 132 provided on the surface of the floating plates **114*b*** as shown in FIG. 2 (*b*) are all aligned with their longest dimension along the direction of the flow of the fluid so as not to disturb it.

In addition, the bottom of each dimple contacts with the adjacent floating plates to serve as a spacer for maintaining the spacing between the floating plates as well as a reinforcing member of the heat exchanger along its vertical direction.

Furthermore, the heat exchanger of this embodiment comprises a more precise mechanism for aligning the flow of the fluid. For the precise control of the flow of the fluid, a comb-shaped baffle whose length projecting into the heat exchanger is controllable is mounted in the air channel of the exchanger plate because the flow locally shortcuts in the air channel even with the structure explained above. In this embodiment, the comb-shaped baffer is realized by extending the stopper 115*b*, which prevents the roll springs 110 in FIG. 1 from getting out of place, toward the inside of the air channel.

The counterflow type floating plate heat exchanger according to the present invention thus manufactured, in spite of its simple construction for assembly and its compact profile, presents a high heat exchange efficiency as a counterflow type heat exchanger.

INDUSTRIAL APPLICABILITY

The heat exchanger of the present invention so far explained in detail is able to endure larger temperature difference than the heat exchanger in which the heat exchanger plates are welded to their supporting members. In addition, all the advantages of the floating plate type heat exchanger of the prior art can be utilized in the present invention: the heat exchanger plates in which a plurality of dimples are provided on the surface has a good heat exchange efficiency because of large contact surface to the high temperature fluid and the low temperature fluid; and the dimples can be pressed out from a steel plate so that, in assembling the heat exchanger, there is no additional operations for mounting independent spacers such as ribs between the heat exchanger plates.

Furthermore, the floating plate type heat exchanger according to the present invention has a counterflow structure in which heat exchanging efficiency is in principle high. Accordingly, heat transfer surface can be reduced compared with a crossflow type heat exchanger. In addition, duct work can be omitted because a multistage structure is unnecessary.

Thus, a high-performance heat exchanger which can be easily fabricated is realized according to the present invention. This heat exchanger can be, for example, advantageously used as an air preheater for furnaces, boilers, incinerators, distillation apparatus and the like, as well as in other fields.

We claim:

1. A counterflow type floating plate heat exchanger comprising an enclosing frame including a pair of parallel rectangular wall members and four corner members connecting the pair of wall members at least at corresponding corners;

four pieces of seal strips in contact with an inside surface of the corner members through resilient members for sealing at least the inside surface of each corner member, a pair of seal strips at diagonal positions with respect to a line connecting respective centers of the wall members being extended along a pair of planes defined by longer sides of the wall members and the corner members so that the planes are sealed leaving unsealed portions thereof to serve as entrances or exits;

at least three separate parallel floating plates, mounted, in parallel to the wall members and in contact with the seal strips, within a space defined by the seal strips and the wall members;

spacer means for maintaining a spacing between the floating plates for channels defined between the floating plates; and control means for evenly diffusing and aligning the flow of fluids in the channels;

in which fluids which are different in temperature respectively flow in adjacent channels on opposite surfaces of each floating plate and heat exchange is realized between the fluids through each floating plate, and wherein the fluids which are different in temperature flow in directions opposite to each other and along the direction of the longer sides in a predetermined portion of the channels.

2. A counterflow type floating plate heat exchanger as claimed in claim 1, wherein the ratio of the length between the longer side and a shorter side in the portion for heat exchange of the floating plate is 7:2.5.

3. A counterflow type floating plate heat exchanger as claimed in claim 2, wherein the dimples are appropriately arranged so as to form means for controlling the flow of fluids.

4. A counterflow type floating plate heat exchanger as claimed in claim 2, wherein the means for controlling the flow of the fluids comprises a plate-like member mounted at an entrance or at an exit of the fluids.

5. A counterflow type floating plate heat exchanger as claimed in claim 2, wherein heat insulators are inserted between the seal strips and the wall members.

6. A counterflow type floating plate heat exchanger as claimed in claim 1 or claim 2, wherein each of the floating plates comprises a plurality of elongated circular dimples projecting from one surface and/or another surface of the floating plate, the height of the dimples defining the spacing between the adjacent floating plates.

7. A counterflow type floating plate heat exchanger as claimed in claim 6, wherein the dimples are appropriately arranged so as to form means for controlling the flow of fluids.

8. A counterflow type floating plate heat exchanger as claimed in claim 6, wherein the means for controlling the flow of the fluids comprises a plate-like member mounted at an entrance or at an exit of the fluids.

9. A counterflow type floating plate heat exchanger as claimed in claim 6, wherein heat insulators are inserted between the seal strips and the wall members.

10. A counterflow type floating plate heat exchanger as claimed in claim 1 wherein the dimples are appropriately arranged so as to form means for controlling the flow of the fluids.

11. A counterflow type floating plate heat exchanger as claimed in claim 10, wherein the means for controlling the flow of the fluids comprises a plate-like member mounted at an entrance or at an exit of the fluids.

12. A counterflow type floating plate heat exchanger as claimed in claim 10 wherein heat insulators are inserted between the seal strips and the wall members.

13. A counterflow type floating plate heat exchanger as claimed in claim 1, wherein the means for controlling the flow of the fluids comprises a plate-like member mounted at an entrance or at an exit of the fluids.

14. A counterflow type floating plate heat exchanger as claimed in claim 13, wherein heat insulators are inserted between the seal strips and the wall members.

15. A counterflow type floating plate heat exchanger as claimed in claim 1 wherein heat insulators are inserted between the seal strips and the wall members.

* * * * *

UNITED STATES PATENT AND TRADEMARK OFFICE

CERTIFICATE OF CORRECTION

PATENT NO. : 4,805,695

DATED : Feb. 21, 1989

INVENTOR(S) : ISHIKAWA et al

It is certified that error appears in the above-identified patent and that said Letters Patent is hereby corrected as shown below:

Please correct the title to -- Floating Plate Counterflow Heat Exchanger --.

Signed and Sealed this

Twenty-fifth Day of July, 1989

*Attest:*

*Attesting Officer*

DONALD J. QUIGG

*Commissioner of Patents and Trademarks*